US010788031B2

(12) United States Patent
Singal et al.

(10) Patent No.: US 10,788,031 B2
(45) Date of Patent: Sep. 29, 2020

(54) METHODS AND SYSTEM FOR ENHANCING FLOW OF A FLUID INDUCED BY A ROD PUMPING UNIT

(71) Applicant: General Electric Company, Schenectady, NY (US)

(72) Inventors: Kalpesh Singal, Glenville, NY (US); Fatemeh Zamanian, Humble, TX (US); Shyam Sivaramakrishnan, Schenectady, NY (US)

(73) Assignee: Ravdos Holdings Inc., New York, NY (US)

( * ) Notice: Subject to any disclaimer, the term of this patent is extended or adjusted under 35 U.S.C. 154(b) by 1459 days.

(21) Appl. No.: 14/575,819

(22) Filed: Dec. 18, 2014

(65) Prior Publication Data

US 2016/0177941 A1 Jun. 23, 2016

(51) Int. Cl.
*F04B 49/12* (2006.01)
*F04B 47/02* (2006.01)
(Continued)

(52) U.S. Cl.
CPC ..... *F04B 49/12* (2013.01); *F04B 47/02* (2013.01); *F04B 47/022* (2013.01); *F04B 49/065* (2013.01); *F04B 51/00* (2013.01)

(58) Field of Classification Search
None
See application file for complete search history.

(56) References Cited

U.S. PATENT DOCUMENTS 4,509,901 A * 4/1985 McTamaney ..... E21B 47/0008 166/250.15
4,973,226 A * 11/1990 McKee ..... E21B 47/0008 417/18

(Continued)

FOREIGN PATENT DOCUMENTS

GB 2089531 A 6/1982
WO 9321442 A1 10/1993

(Continued)

OTHER PUBLICATIONS

PCT Search Report and Written Opinion issued in connection with corresponding Application No. PCT/US2015/065721 dated Mar. 8, 2016.

(Continued)

*Primary Examiner* — Mohammad Ali
*Assistant Examiner* — Saad M Kabir
(74) *Attorney, Agent, or Firm* — Dentons Cohen & Grigsby P.C.

(57) ABSTRACT

A system for enhancing a flow of a fluid induced by a rod pumping unit is provided. The system includes one or more sensors and a pumping control unit configured to control stroke movement of the rod pumping unit. The pumping control unit is configured to: (a) initiate at least one stroke of the rod pumping unit; (b) receive sensor data from the one or more sensors; (c) upon determination of a violation of a first set of constraints, make a first adjustment to the current stroke timing, and return to step (a); (d) upon determination of a violation of a second set of constraints, make a second adjustment to the current stroke timing, and return to step (a); and (e) upon determination of no violation of at least one set of constraints make a third adjustment to the current stroke timing, and return to step (a).

23 Claims, 7 Drawing Sheets

(51) Int. Cl.
*F04B 49/06* (2006.01)
*F04B 51/00* (2006.01)

(56) References Cited

U.S. PATENT DOCUMENTS 5,281,100 A * 1/1994 Diederich ..... E21B 43/127 417/18
5,481,873 A 1/1996 Saruwatari et al.
6,343,656 B1 2/2002 Vazquez et al.
6,890,156 B2 5/2005 Watson et al.
7,316,542 B2 * 1/2008 Mills ..... E21B 47/0007 417/42
7,530,799 B2 5/2009 Smith et al.
8,444,393 B2 5/2013 Beck et al.
8,668,475 B2 3/2014 Gregory et al.
8,844,626 B1 9/2014 Krug
8,851,860 B1 10/2014 Mail
2004/0084179 A1 5/2004 Watson et al.
2011/0103974 A1 5/2011 Lamascus et al.
2012/0205119 A1 8/2012 Wentworth et al.
2012/0251335 A1 10/2012 Hurst et al.
2013/0151216 A1 6/2013 Palka et al.
2013/0306326 A1 * 11/2013 Doyle ..... E21B 43/127 166/369

FOREIGN PATENT DOCUMENTS

WO 2007041823 A1 4/2007
WO 20120154160 A1 11/2012
WO 2013070979 A2 5/2013
WO WO 2015077890 A1 * 6/2015 ..... G06N 7/005

OTHER PUBLICATIONS

Palka Krzysztof et al.; Optimizing Downhole Fluid Production of Sucker-Rod Pumps with Variable Motor Speed; SPE Production & Operations; May 2009; pp. 346-352.
Liu, Xinfu et al.; An Approach to the Optimum Design of Sucker-Rod Pumping System; ICIE 2010 Proceedings of the 2010 WASE International Conference on Information Engineering; Aug. 14-15, 2010; vol. 03; pp. 140-143.

* cited by examiner

METHODS AND SYSTEM FOR ENHANCING FLOW OF A FLUID INDUCED BY A ROD PUMPING UNIT

BACKGROUND

The field of the invention relates generally to controlling rod pumping units, and more specifically, to methods and a system for controlling a rod pumping unit to enhance the flow of a fluid induced by the rod pumping unit.

Most known rod pumping units (also known as surface pumping units) are used in wells to induce fluid flow, for example oil and water. The primary function of the linear pumping unit is to convert rotating motion from a prime mover (e.g., an engine or an electric motor) into reciprocating motion above the wellhead. This motion is in turn used to drive a reciprocating down-hole pump via connection through a sucker rod string. The sucker rod string, which can extend miles in length, transmits the reciprocating motion from the wellhead at the surface to subterranean valves in a fluid bearing zone of the well. The reciprocating motion of the valves induces the fluid to flow up the length of the sucker rod string to the wellhead.

The rod pumping units are exposed to a wide range of conditions. These vary by well application, the type and proportions of the pumping unit's linkage mechanism, and the conditions of the well. Furthermore, well conditions, such as downhole pressure, may change over time. These conditions may cause variability in the flow of the fluid. In addition, these conditions affect the sucker rod string. The sucker rod string transmits dynamic loads from the down-hole pump and the rod pumping unit. The sucker rod string behaves similarly to a spring over long distances. The sucker rod string elongates and retracts based on exposure to variable tensile stress. The response of the sucker rod string is damped somewhat due to its submergence in a viscous fluid (water and oil), but the motion profile of the rod pumping unit combined with the step function loading of the pump generally leaves little time for the oscillations to decay before the next perturbation is encountered.

The rod pumping unit imparts continually varying motion on the sucker rod string. The sucker rod string responds to the varying motion by sending variable stress waves down its length to alter its own motion. The sucker rod string stretches and retracts as it builds the force necessary to move the down-hole pump and fluid. The rod pumping unit, breaking away from the effects of friction and fluid inertia, tends to rebound under the elastic force from the sucker rod string initiating an additional oscillatory response within the sucker rod string. Traveling stress waves from multiple sources interfere with each other along the sucker rod string (some constructively, others destructively) as they traverse its length and reflect load variations back to the rod pumping unit, where they can be measured.

BRIEF DESCRIPTION

In one aspect, a system for enhancing a flow of a fluid induced by a rod pumping unit is provided. The system includes one or more sensors configured to monitor one or more conditions of the rod pumping unit and generate signals representing sensor data based on the one or more conditions and a pumping control unit comprising a processor and a memory. The pumping control unit is in communication with the one or more sensors and is configured to control stroke movement of the rod pumping unit, thereby controlling the flow of the fluid induced by the rod pumping unit. The pumping control unit is configured to (a) initiate at least one stroke of the rod pumping unit. The at least one stroke is based on current stroke timing data, and the current stroke timing data includes a value for strokes per minute (SPM). The pumping control unit is also configured to (b) receive signals representing sensor data from the one or more sensors, (c) upon a determination of, based on the sensor data, a violation of a first set of constraints, make a first adjustment to the current stroke timing, and return to step (a), (d) upon a determination of, based on the sensor data, a violation of a second set of constraints, make a second adjustment to the current stroke timing, and return to step (a), and (e) upon a determination of, based on the sensor data, no violation of at least one set of constraints make a third adjustment to the current stroke timing, and return to step (a).

In a further aspect, a computer-based method for enhancing a flow of a fluid induced by a rod pumping unit is provided. The method is implemented using a pumping control unit in communication with a memory. The method includes (a) initiating at least one stroke of the rod pumping unit. The at least one stroke is based on current stroke timing data, and the current stroke timing data includes a value for strokes per minute (SPM). The method also includes (b) receiving signals representing sensor data from one or more sensors. The one or more sensors are configured to monitor one or more conditions of the rod pumping unit and generate signals representing sensor data based on the one or more conditions. The method further includes (c) upon determining, based on the sensor data, a violation of a first set of constraints, make a first adjustment to the current stroke timing, and return to step (a), (d) upon determining, based on the sensor data, a violation of a second set of constraints, make a second adjustment to the current stroke timing, and return to step (a), and (e) upon determining, based on the sensor data, no violation of at least one set of constraints make a third adjustment to the current stroke timing, and return to step (a).

In another aspect, a computer-readable storage device having processor-executable instructions embodied thereon for enhancing a flow of a fluid induced by a rod pumping unit is provided. When executed by a pumping control unit communicatively coupled to a memory, the processor-executable instructions cause the pumping control unit to (a) initiate at least one stroke of the rod pumping unit. The at least one stroke is based on current stroke timing data, and the current stroke timing data includes a value for strokes per minute (SPM). The processor-executable instructions also cause the pumping control unit to (b) receive signals representing sensor data from one or more sensors. The one or more sensors are configured to monitor one or more conditions of the rod pumping unit and generate signals representing sensor data based on the one or more conditions. The processor-executable instructions further cause the pumping control unit to (c) upon a determination of, based on the sensor data, a violation of a first set of constraints, make a first adjustment to the current stroke timing, and return to step (a), (d) upon a determination of, based on the sensor data, a violation of a second set of constraints, make a second adjustment to the current stroke timing, and return to step (a), and (e) upon a determination of, based on the sensor data, no violation of at least one set of constraints make a third adjustment to current stroke timing, and return to step (a).

DRAWINGS

These and other features, aspects, and advantages of the present disclosure will become better understood when the following detailed description is read with reference to the accompanying drawings in which like characters represent like parts throughout the drawings, wherein.

Figure 1B:
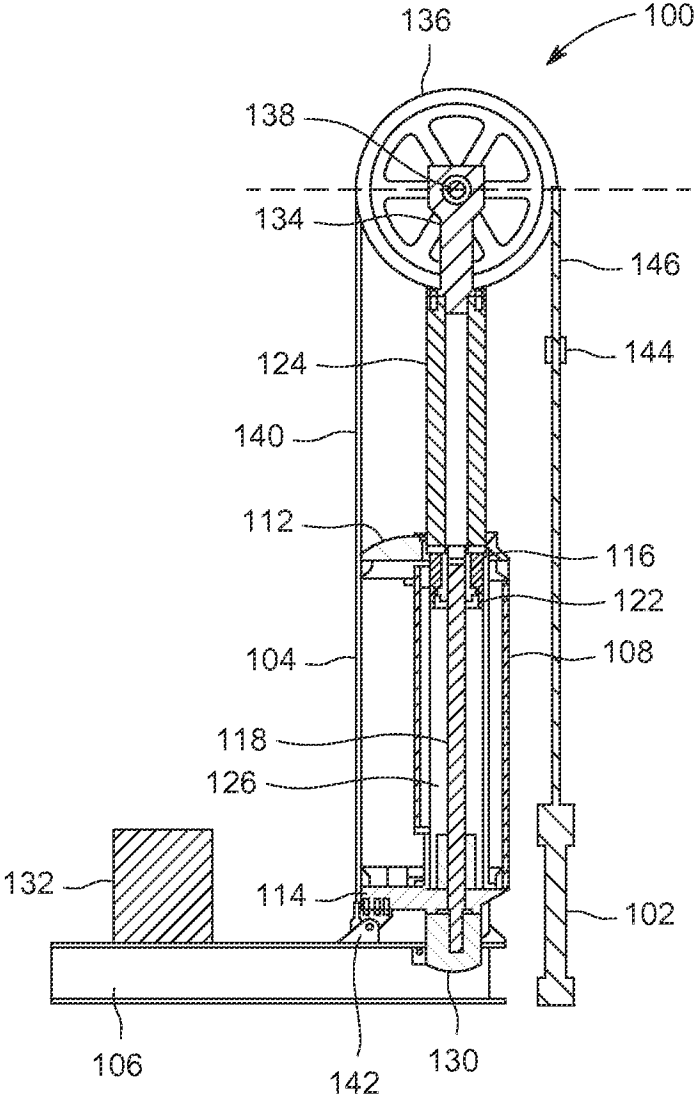
FIG. 1B is a cross-sectional view of the rod pumping unit shown in FIG. 1A in a fully extended position.

Unless otherwise indicated, the drawings provided herein are meant to illustrate features of embodiments of the disclosure. These features are believed to be applicable in a wide variety of systems comprising one or more embodiments of the disclosure. As such, the drawings are not meant to include all conventional features known by those of ordinary skill in the art to be required for the practice of the embodiments disclosed herein.

DETAILED DESCRIPTION

In the following specification and the claims, reference will be made to a number of terms, which shall be defined to have the following meanings.

The singular forms "a", "an", and "the" include plural references unless the context clearly dictates otherwise.

"Optional" or "optionally" means that the subsequently described event or circumstance may or may not occur, and that the description includes instances where the event occurs and instances where it does not.

Approximating language, as used herein throughout the specification and claims, may be applied to modify any quantitative representation that may permissibly vary without resulting in a change in the basic function to which it is related. Accordingly, a value modified by a term or terms, such as "about", "approximately", and "substantially", are not to be limited to the precise value specified. In at least some instances, the approximating language may correspond to the precision of an instrument for measuring the value. Here and throughout the specification and claims, range limitations may be combined and interchanged, such ranges are identified and include all the sub-ranges contained therein unless context or language indicates otherwise.

As used herein, the terms "processor" and "computer" and related terms, e.g., "processing device", "computing device", and "controller" are not limited to just those integrated circuits referred to in the art as a computer, but broadly refers to a microcontroller, a microcomputer, a programmable logic controller (PLC), an application specific integrated circuit, and other programmable circuits, and these terms are used interchangeably herein. In the embodiments described herein, memory may include, but is not limited to, a computer-readable medium, such as a random access memory (RAM), and a computer-readable non-volatile medium, such as flash memory. Alternatively, a floppy disk, a compact disc—read only memory (CD-ROM), a magneto-optical disk (MOD), and/or a digital versatile disc (DVD) may also be used. Also, in the embodiments described herein, additional input channels may be, but are not limited to, computer peripherals associated with an operator interface such as a mouse and a keyboard. Alternatively, other computer peripherals may also be used that may include, for example, but not be limited to, a scanner. Furthermore, in the exemplary embodiment, additional output channels may include, but not be limited to, an operator interface monitor.

Further, as used herein, the terms "software" and "firmware" are interchangeable, and include any computer program stored in memory for execution by personal computers, workstations, clients and servers.

As used herein, the term "non-transitory computer-readable media" is intended to be representative of any tangible computer-based device implemented in any method or technology for short-term and long-term storage of information, such as, computer-readable instructions, data structures, program modules and sub-modules, or other data in any device. Therefore, the methods described herein may be encoded as executable instructions embodied in a tangible, non-transitory, computer readable medium, including, without limitation, a storage device and a memory device. Such instructions, when executed by a processor, cause the processor to perform at least a portion of the methods described herein. Moreover, as used herein, the term "non-transitory computer-readable media" includes all tangible, computer-readable media, including, without limitation, non-transitory computer storage devices, including, without limitation, volatile and nonvolatile media, and removable and non-removable media such as a firmware, physical and virtual storage, CD-ROMs, DVDs, and any other digital source such as a network or the Internet, as well as yet to be developed digital means, with the sole exception being a transitory, propagating signal.

Furthermore, as used herein, the term "real-time" refers to at least one of the time of occurrence of the associated events, the time of measurement and collection of predetermined data, the time to process the data, and the time of a system response to the events and the environment. In the embodiments described herein, these activities and events occur substantially instantaneously.

The rod pumping control system as described herein provide a cost-effective method for controlling a rod pumping unit to enhance the flow of a fluid induced by the rod pumping unit based on current well conditions. Furthermore, the motion of the rod pumping unit is repeatedly updated to ensure that the motion of the sucker rod string will not damage the sucker rod string, the rod pumping unit, or the well itself. Also, the system and methods described herein are not limited to any single predefined set of well conditions. For example, the system and methods described herein may be used with varying well conditions and adapt over time as well conditions change. As such, the amount of flow of fluid induced by the rod pumping unit is constantly updated to be enhanced based on current well conditions and the capabilities of the rod pumping unit. As such, the production and efficiency of rod pumping units is increased.

Figure 1A:
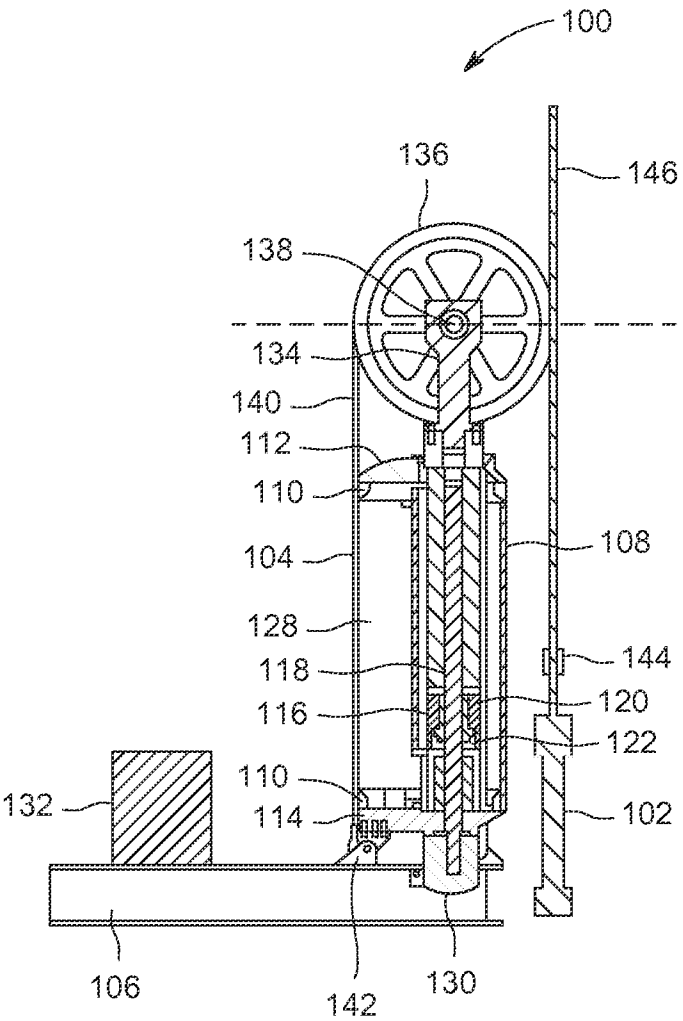
FIG. 1A is a cross-sectional view of an exemplary rod pumping unit in a fully retracted position.

FIGS. 1A and 1B are cross-sectional views of an exemplary rod pumping unit 100 in fully retracted (1A) and fully extended (1B) positions. In the exemplary embodiment, rod pumping unit 100 (also known as a linear pumping unit) is a vertically oriented rod pumping unit having a linear motion vertical vector situated adjacent to a wellhead 102. Rod pumping unit 100 is configured to transfer vertical linear motion into a subterranean well (not shown) through a sucker rod string (not shown) for inducing the flow of a fluid. Rod pumping unit 100 includes a pressure vessel 104 coupled to a mounting base structure 106. In some embodiments, mounting base structure 106 is anchored to a stable foundation situated adjacent to the fluid-producing subterranean well. Pressure vessel 104 may be composed of a cylindrical or other appropriately shaped shell body 108 constructed of formed plate and cast or machined end flanges 110. Attached to the end flanges 110 are upper and lower pressure heads 112 and 114, respectively.

Penetrating upper and lower pressure vessel heads 112 and 114, respectively, is a linear actuator assembly 116. This linear actuator assembly 116 is includes a vertically oriented threaded screw 118 (also known as a roller screw), a planetary roller nut 120 (also known as a roller screw nut assembly), a forcer ram 122 in a forcer ram tube 124, and a guide tube 126.

Roller screw 118 is mounted to an interior surface 128 of lower pressure vessel head 114 and extends up to upper pressure vessel head 112. The shaft extension of roller screw 118 continues below lower pressure vessel head 114 to connect with a compression coupling (not shown) of a motor 130. Motor 130 is coupled to a variable speed drive (VSD) (not shown) configured such that the motor's 130 rotating speed may be adjusted continuously. The VSD also reverses the motor's 130 direction of rotation so that its range of torque and speed may be effectively doubled. Roller screw 118 is operated in the clockwise direction for the upstroke and the counterclockwise direction for the downstroke. Motor 130 is in communication with a pumping unit controller 132. In the exemplary embodiment, pumping unit controller 132 transmits commands to motor 130 and the VSD to control the speed, direction, and torque of roller screw 118.

Within pressure vessel 104, the threaded portion of roller screw 118 is interfaced with planetary roller screw nut assembly 120. Nut assembly 120 is fixedly attached to the lower segment of forcer ram 122 such that as roller screw 118 rotates in the clockwise direction, forcer ram 122 moves upward. Upon counterclockwise rotation of roller screw 118, forcer ram 122 moves downward. This is shown generally in FIGS. 1A and 1B. Guide tube 126 is situated coaxially surrounding forcer tube 124 and statically mounted to lower pressure head 114. Guide tube 126 extends upward through shell body 108 to slide into upper pressure vessel head 112.

An upper ram 134 and a wireline drum assembly 136 are fixedly coupled and sealed to the upper end of forcer ram 122 are. Wireline drum assembly 136 includes an axle 138 that passes laterally through the top section of the upper ram 134. A wireline 140 passes over wireline drum assembly 136 resting in grooves machined into the outside diameter of wireline drum assembly 136. Wireline 140 is coupled to anchors 142 on the mounting base structure 106 at the side of pressure vessel 104 opposite of wellhead 102. At the wellhead side of pressure vessel 104, wireline 140 is coupled to a carrier bar 144 which is in turn coupled to a polished rod 146 extending from wellhead 102.

Rod pumping unit 100 transmits linear force and motion through planetary roller screw nut assembly 120. Motor 130 is coupled to the rotating element of planetary roller screw nut assembly 120. By rotation in either the clockwise or counterclockwise direction, motor 130 may affect translatory movement of planetary roller nut 120 (and by connection, to forcer ram 122) along the length of roller screw 118.

Figure 2:
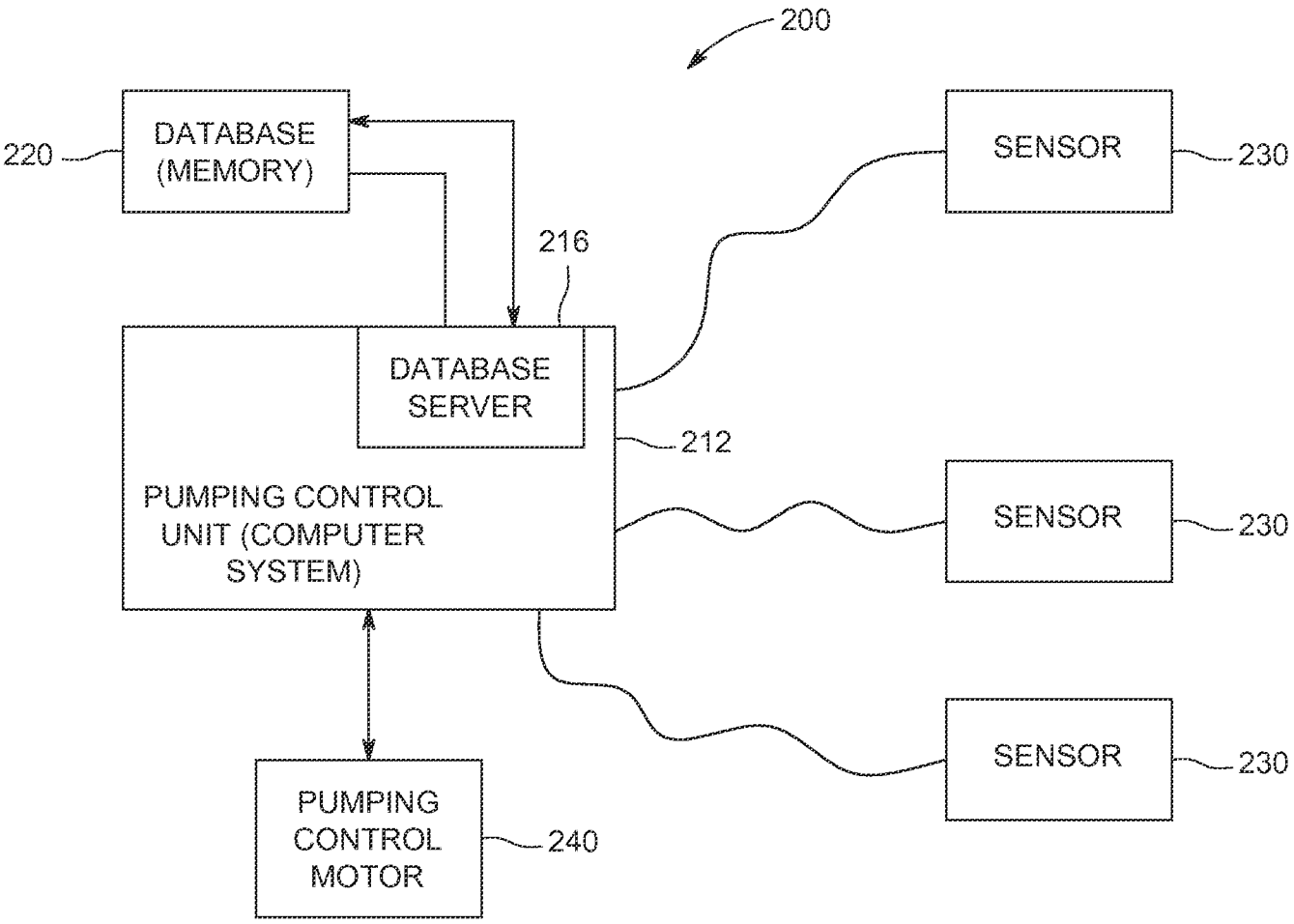
FIG. 2 is a schematic view of a system for controlling the rod pumping unit shown in FIGS. 1A and 1B.

FIG. 2 is a schematic view of a system 200 for controlling rod pumping unit 100 (shown in FIGS. 1A and 1B). In the exemplary embodiment, system 200 is used for compiling and responding to data from a plurality of sensors 230 and controlling the stroke of rod pumping unit 100. Sensors 230 are in communication with a pumping control unit 212. Sensors 230 connect to pumping control unit 212 through many interfaces including without limitation a network, such as a local area network (LAN) or a wide area network (WAN), dial-in-connections, cable modems, Internet connection, wireless, and special high-speed Integrated Services Digital Network (ISDN) lines. Sensors 230 receive data about conditions of rod pumping unit 100 and report those conditions to pumping control unit 212. Pumping control unit 212 may include, but is not limited to, pumping unit controller 124 (shown in FIG. 1).

Pumping control unit 212 is in communication with pumping control motor 240. In the exemplary embodiment, pumping control motor 240 includes motor 134 (shown in FIG. 1A) and a VSD (not shown). Pumping control motor 240 transmits data to pumping control unit 212 and receives commands from pumping control unit 212. Pumping control motor 240 connects to pumping control unit 212 through many interfaces including without limitation a network, such as a local area network (LAN) or a wide area network (WAN), dial-in-connections, cable modems, Internet connection, wireless, and special high-speed Integrated Services Digital Network (ISDN) lines.

A database server 216 is coupled to database 220, which contains information on a variety of matters, as described below in greater detail. In one embodiment, centralized database 220 is stored on pumping control unit 212. In an alternative embodiment, database 220 is stored remotely from pumping control unit 212 and may be non-centralized. In some embodiments, database 220 includes a single database having separated sections or partitions or in other embodiments, database 220 includes multiple databases, each being separate from each other. Database 220 stores condition data received from multiple sensors 230. In addition, database 220 stores constraints, component data, component specifications, equations, and historical data generated as part of collecting condition data from multiple sensors 230.

In some embodiments, pumping control unit 212 is in communication with a client device (not shown). Pumping control unit 212 connects to client device through many interfaces including without limitation a network, such as a local area network (LAN) or a wide area network (WAN), dial-in-connections, cable modems, Internet connection, wireless, and special high-speed Integrated Services Digital Network (ISDN) lines. In these embodiments, pumping control unit 212 transmits data about the operation of rod pumping unit 100 to client device. This data could include data from sensors, current strokes per minute and other operational data that client device could monitor. Furthermore, pumping control unit 212 could receive additional instructions from client device. Additionally, client device could access database 220 through pumping control unit 212. Client device could present the data from pumping control unit to a user. In other embodiments, pumping control unit could include a display unit (not shown) to display data directly to a user.

Figure 3:
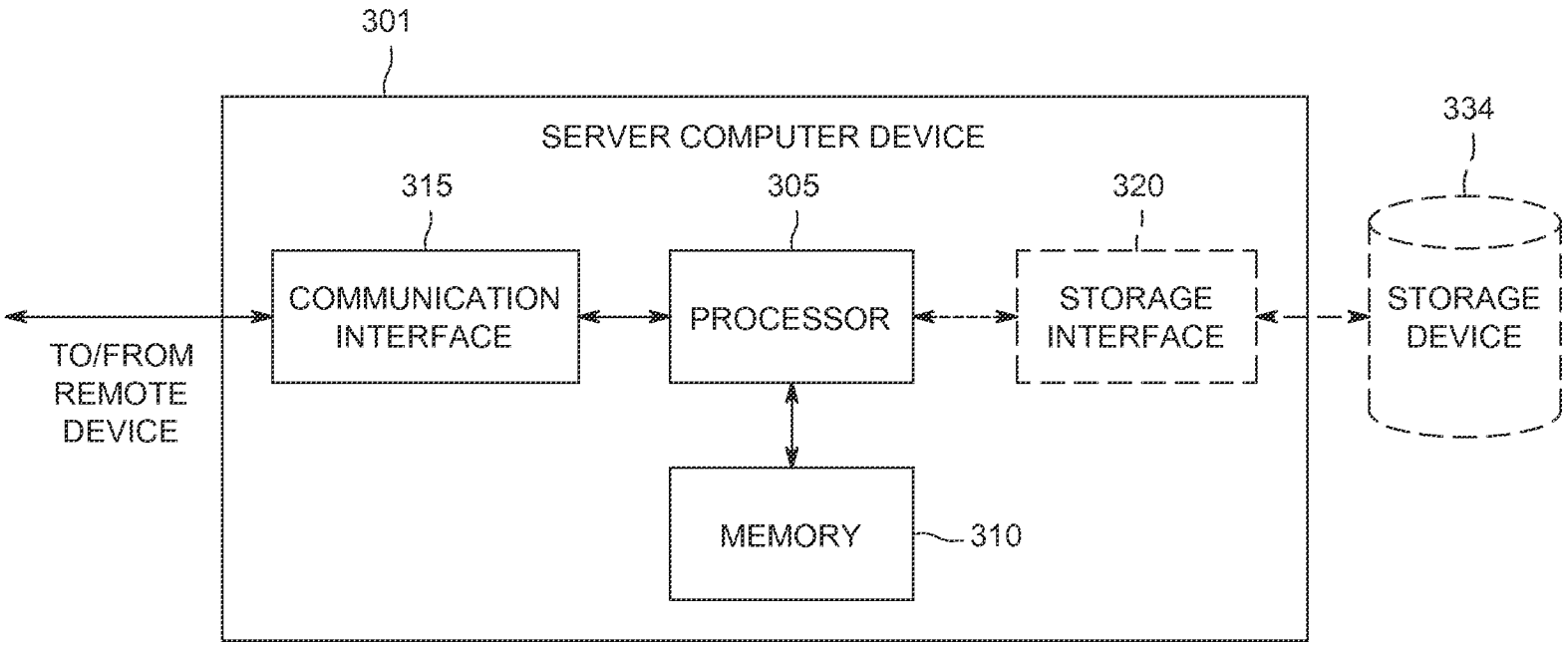
FIG. 3 is a schematic view of an exemplary configuration of a pumping control unit that may be used with the system shown in FIG. 2.

FIG. 3 is a schematic view of an exemplary configuration of pumping control unit 212 that may be used with system 200 (shown in FIG. 2). More specifically, server computer device 301 may include, but is not limited to, pumping control unit 212 and database server 216 (shown in FIG. 2). Server computer device 301 also includes a processor 305 for executing instructions. Instructions may be stored in a memory area 310. Processor 305 may include one or more processing units (e.g., in a multi-core configuration).

Processor 305 is operatively coupled to a communication interface 315 such that server computer device 301 is capable of communicating with a remote device such as another server computer device 301, sensors 230, or pumping control motor 240 (both shown in FIG. 2). For example, communication interface 315 may receive data from sensors 230 via a LAN, as illustrated in FIG. 2.

Processor 305 may also be operatively coupled to a storage device 334. Storage device 334 is any computer-operated hardware suitable for storing and/or retrieving data, such as, but not limited to, data associated with database 220 (shown in FIG. 2). In some embodiments, storage device 334 is integrated in server computer device 301. For example, server computer device 301 may include one or more hard disk drives as storage device 334. In other embodiments, storage device 334 is external to server computer device 301 and may be accessed by a plurality of server computer devices 301. For example, storage device 334 may include a storage area network (SAN), a network attached storage (NAS) system, and/or multiple storage units such as hard disks and/or solid state disks in a redundant array of inexpensive disks (RAID) configuration.

In some embodiments, processor 305 is operatively coupled to storage device 334 via a storage interface 320. Storage interface 320 is any component capable of providing processor 305 with access to storage device 334. Storage interface 320 may include, for example, an Advanced Technology Attachment (ATA) adapter, a Serial ATA (SATA) adapter, a Small Computer System Interface (SCSI) adapter, a RAID controller, a SAN adapter, a network adapter, and/or any component providing processor 305 with access to storage device 334.

Processor 305 executes computer-executable instructions for implementing aspects of the disclosure. In some embodiments, processor 305 is transformed into a special purpose microprocessor by executing computer-executable instructions or by otherwise being programmed. For example, processor 305 is programmed with instruction as described further below.

Figure 4:
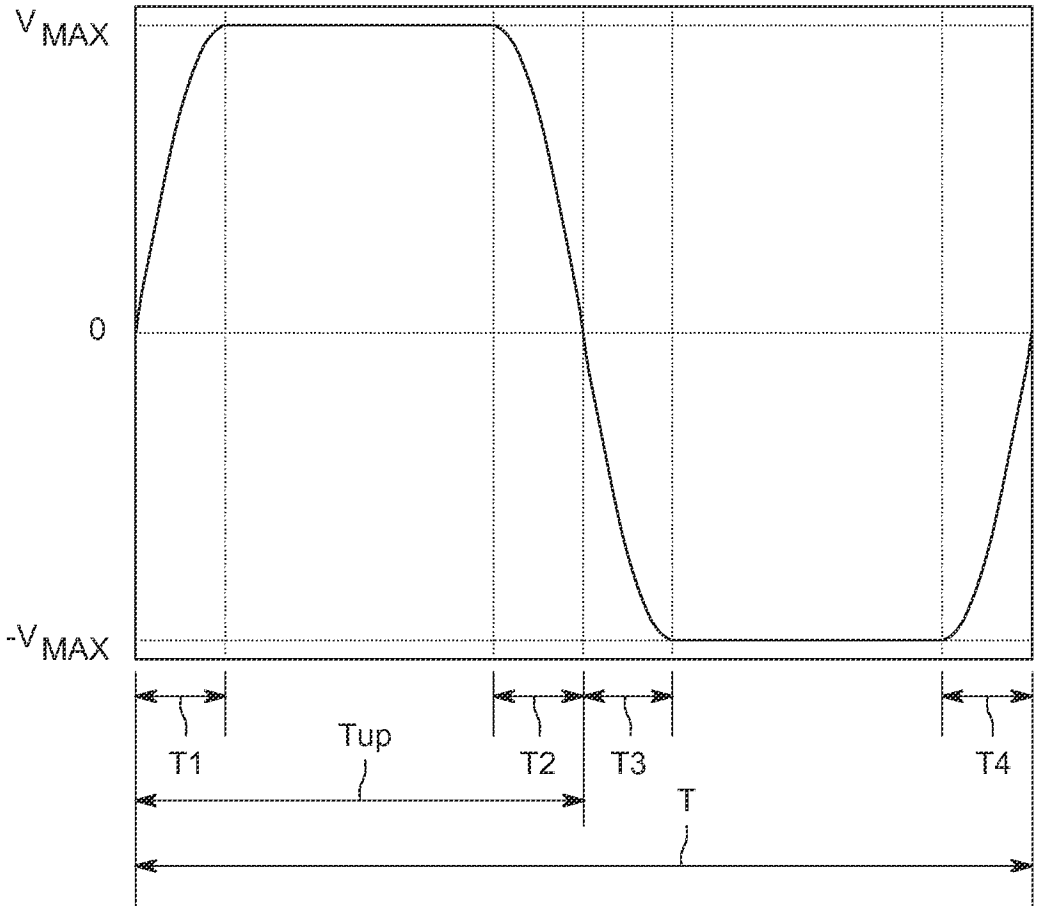
FIG. 4 is a graphical view of an exemplary velocity profile of a stroke of the rod pumping unit shown in FIGS. 1A and 1B.

FIG. 4 is a graphical view of an exemplary velocity profile 400 of a stroke of rod pumping unit 100 (shown in FIGS. 1A and 1B). Velocity profile 400 illustrates the velocity of the upper ram 134 (shown in FIG. 1B). The x-axis of velocity profile 400 is time T and the y-axis is the velocity of upper ram 134 in relation to mounting base structure 106 (both shown in FIG. 1A). Time T represents the time that it takes rod pumping unit 100 to complete one stroke from fully retracted to fully extended and back to fully retracted. Therefore if T is equal to 60 seconds, then rod pumping unit 100 completes 1 stroke per minute (SPM). If T is equal to 10 seconds, then SPM is 6.

On the left side of velocity profile at time T=0 rod pumping unit 100 is fully retracted as is shown in FIG. 1A. Time Tup represents the amount of time that it takes for rod pumping unit to go from fully retracted to fully extended. Tup is also known as the upstroke time, while (T−Tup) is the downstroke time. Vmax is the maximum velocity at which rod pumping unit 100 may extend or retract. In the exemplary embodiment, Vmax is based on the attributes of rod pumping unit 100. In the exemplary embodiment, the absolute value of Vmax on the upstroke is the same as absolute value of Vmax on the downstroke. However, in other embodiments, the absolute values of the upstroke and downstroke velocities are different.

Time T1 represents the amount of time it takes for rod pumping unit 100 to accelerate from a standstill condition, i.e., velocity equal to 0, to Vmax while extending. Time T2 represents the amount of time it takes rod pumping unit 100 to decelerate from Vmax to 0 while extending, when rod pumping unit 100 reaches the apex of its extension. Time T3 represents the amount of time it takes for rod pumping unit 100 to accelerate from still to −Vmax while retracting. Time T4 represents the amount of time it takes rod pumping unit 100 to decelerate from −Vmax to 0 while retracting, when rod pumping unit 100 becomes fully retracted. In some embodiments, T4 is the same amount of time as T1.

Pumping control unit 212 sets T, Tup, T1, T2, T3, and T4 and instructs pumping control motor 240 (shown in FIG. 2) to rotate roller screw 118 (shown in FIG. 1) to implement the required timing. These variables are also known as the stroke timing as they control each stage of the stroke.

Figure 5:
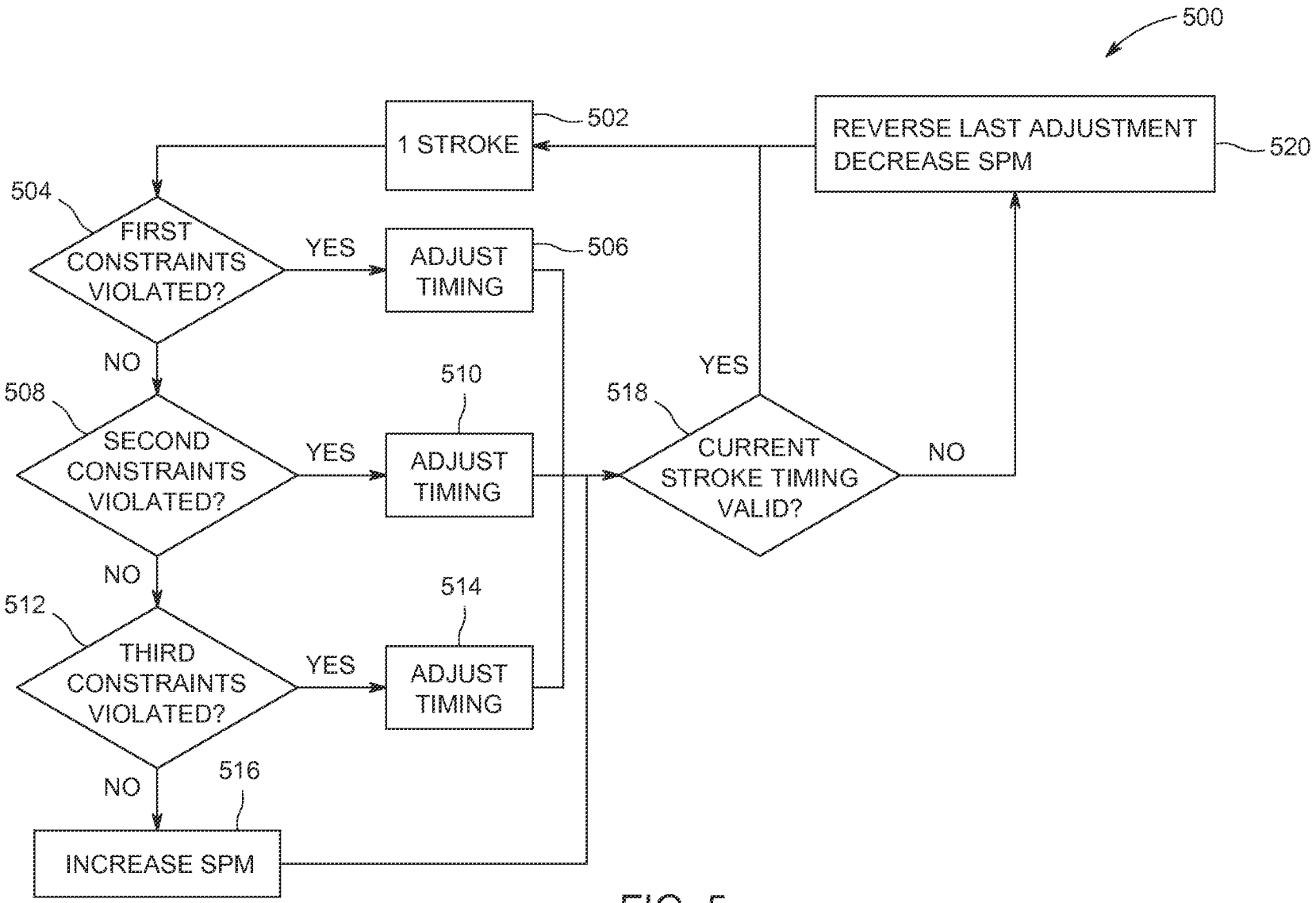
FIG. 5 is a flow chart of a pumping process using the rod pumping unit shown in FIGS. 1A and 1B.

FIG. 5 is a flow chart of a pumping process 500 using the rod pumping unit 100 (shown in FIGS. 1A and 1B). Process 500 is configured to increase the strokes per minute (SPM) of rod pumping unit 100 while ensuring that damage does not occur to the sucker rod string. The amount of flow of fluid induced is directly proportional to the SPM, therefore, optimizing the SPM is desirable. The SPM is controlled by pumping control unit 212 (shown in FIG. 2). SPM is calculated as 60/T, where T is stroke time in seconds. In addition to the SPM, pumping control unit 212 also controls T1, T2, T3, T4, and Tup as shown in FIG. 4. Through the manipulation of these variables, pumping control unit 212 can also ensure that rod pumping unit 100 does not violate the constraints which are configured to ensure proper operation of rod pumping unit 100.

In the exemplary embodiment, pumping control unit 212 monitors three sets of constraints. In other embodiments, there may be more or fewer sets of constraints, or the sets may contain different constraints or be calculated in different methods. The constraints are ordered based on a hierarchy. In the exemplary embodiment, the first set of constraints is based on the load and power specifications of rod pumping unit 100. These constraints are predetermined based on the individual rod pumping unit 100. These constraints may vary based on model or between different rod pumping units. These constraints include, but are not limited to, peak polished rod load, max screw load (compressive/tensile), max motor power, max motor torque, root mean square of motor power, root mean square of motor torque, allowable pressure rating of pressure vessel 104 (shown in FIG. 1), and maximum screw angular velocity. These constraints may have to be updated as parts are swapped out in rod pumping unit 100.

The second set of constraints is designed to prevent buckling of the sucker rod string. The cross-section of the sucker rod string is not constant and varies along its length. To account for these varying thicknesses, the minimum effective load is calculated at multiple points (also known as taper points). The minimum effective load is further modified by a safety factor. These constraints are updated based on the dimensions of the sucker rod string and will be updated when a different sucker rod string with different dimensions is used.

The third set of constraints is designed to prevent fatigue in the sucker rod string. The sucker rod string is constantly under tension and less tension, this is to prevent ever putting the sucker rod string under compression force. These constant changes in tension are a cyclical stress on the sucker rod string. The effect that this cyclical stress has on the sucker rod string is known as fatigue. The fatigue constraints are based on the maximum and minimum stress that is placed on the sucker rod string during a cycle in view of the tensile strength of the sucker rod. These constraints are further modified by a service factor. In the exemplary embodiment, the service factor is in addition to any safety factor being used and reflects the condition of the well.

Pumping control unit 212 stores starting stroke timing for process 500, which includes values for T, T1, T2, T3, T4, Tup, and Vmax. Pumping control unit 212 begins process 500 by instructing rod pumping unit 100 to perform 502 one stroke using the starting stroke timing. While in the exemplary embodiment only one stroke is performed in Step 502, in other embodiments, multiple strokes may be performed. During the stroke, pumping control unit 212 receives data from sensors 230 (shown in FIG. 2) about the conditions of rod pumping unit 100 during the different stages of the stroke. Pumping control unit 212 determines 504 if the first set of constraints were violated during the stroke. At least one of the constraints in the set of constraints has to be violated for the determination to be true. If the first set of constraints was violated, pumping control unit 212 adjusts 506 the stroke timing based on the violation of the first set of constraints. Then pumping control unit 212 determines 518 if the current stroke timing is valid. For example, is T1+T2+T3+T4>T. If the current stroke timing is valid, pumping control unit 212 returns to Step 502 and initiates a stroke based on the current stroke timing. If the current stroke timing is not valid, pumping control unit 212 reverses 520 the last adjustment made to current stroke timing and increases T, which thereby decreases SPM. Pumping control unit 212 returns to Step 502 and initiates a stroke based on the adjusted stroke timing.

If the first set of constraints was not violated during the stroke, pumping control unit 212 determines 508 if the second set of constraints were violated. If the second set of constraints were violated, pumping control unit 212 adjusts 510 the current stroke timing based on the violation of the second set of constraints. Pumping control unit 212 determines 518 if the current stroke timing is valid. If the current stroke timing is valid, pumping control unit 212 returns to Step 502 and initiates a stroke based on the adjusted current stroke timing.

If the first set and second set of constraints were not violated during the stroke, pumping control unit 212 determines 512 if the third set of constraints were violated. If the third set of constraints were violated, pumping control unit 212 adjusts 514 the current stroke timing based on the violation of the third set of constraints. Pumping control unit 212 determines 518 if the current stroke timing is valid. If the current stroke timing is valid, pumping control unit 212 returns to Step 502 and initiates a stroke based on the adjusted current stroke timing.

If none of the sets of constraints were violated, pumping control unit 212 adjusts 516 current stroke timing by decreasing T to increase SPM. Pumping control unit 212 determines 518 if the current stroke timing is valid. If the current stroke timing is valid, pumping control unit 212 returns to Step 502 and initiates a stroke based on the adjusted current stroke timing. Process 500 is designed to achieve an optimal SPM or pumping speed for rod pumping unit 100 through multiple iterations. Since process 500 is in real-time, the current stroke timing is based on current conditions in the well.

Pumping control unit 212 also stores a LAST_FAIL_MODE variable and a LAST_MODIFICATION variable. The LAST_FAIL_MODE is updated with the last constraint failure that pumping control unit 212 detected. If pumping control unit 212 determines 504 that the first set of constraints was violated, then LAST_FAIL_MODE is updated to represent a violation of the first set of constraints. The highest set of constraints that was violated is listed in the LAST_FAIL_MODE variable. For example, if the first set of constraints and the third set of constraints were violated, then the first set of constraints is listed in the LAST_FAIL_MODE variable. The LAST_MODIFICATION variable is updated to store the last adjustment made to the current stroke timing. For example, in Step 516, when none of the sets of constraints are violated, the LAST_FAIL_MODE is set to NONE. And LAST_MODIFICATION is set to decrease T.

Figure 6:
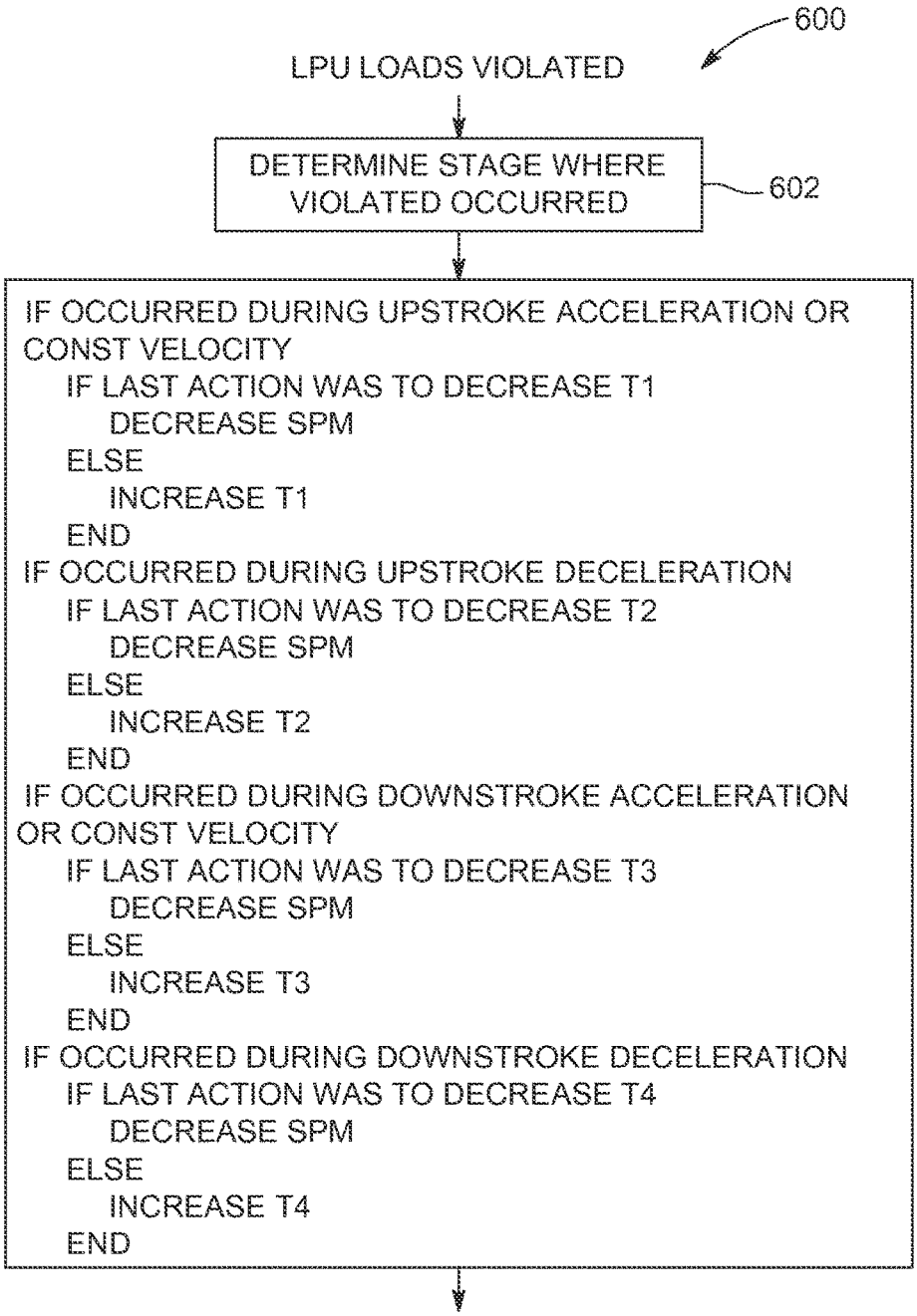
FIG. 6 is a flow chart of a first adjustment process based on adjusting the current stroke timing after the first set of constraints is violated as shown in FIG. 5.

FIG. 6 is a flow chart of a first adjustment process 600 based on adjusting 506 the current stroke timing after the first set of constraints is violated (shown in FIG. 5). First adjustment process 600 is configured to adjust current stroke timing in response to a violation of the first set of constraints. In the exemplary embodiment, the first set of constraints is based on the load and power specifications of rod pumping unit 100 (shown in FIG. 1). Pumping control unit 212 determines 602 during which stage of the stroke that the violation occurred based on the data from sensors 230 (shown in FIG. 2). The stages are based on the velocity profile 400 (shown in FIG. 4).

If the violation occurred during upstroke acceleration (T1) or during upstroke constant velocity (the time between T1 and T2), pumping control unit 212 determines if LAST_MODIFICATION was to decrease T1. If the determination is true, pumping control unit 212 increases T, thereby decreasing SPM. If the determination is false, pumping control unit 212 increases T1.

If the violation occurred during upstroke deceleration (T2), pumping control unit 212 determines if LAST_MODIFICATION was to decrease T2, pumping control unit 212 increases T, thereby decreasing SPM. If the determination is true, pumping control unit 212 increases T, thereby decreasing SPM. If the determination is false, pumping control unit 212 increases T2.

If the violation occurred during downstroke acceleration (T3) or during downstroke constant velocity (the time between T3 and T4), pumping control unit 212 determines if LAST_MODIFICATION was to decrease T3. If the determination is true, pumping control unit 212 increases T, thereby decreasing SPM. If the determination is false, pumping control unit 212 increases T3.

If the violation occurred during downstroke deceleration (T4), pumping control unit 212 determines if LAST_MODIFICATION was to decrease T4, pumping control unit 212 increases T, thereby decreasing SPM. The determination is true, pumping control unit 212 increases T, thereby decreasing SPM. If the determination is false, pumping control unit 212 increases T4.

Figure 7:
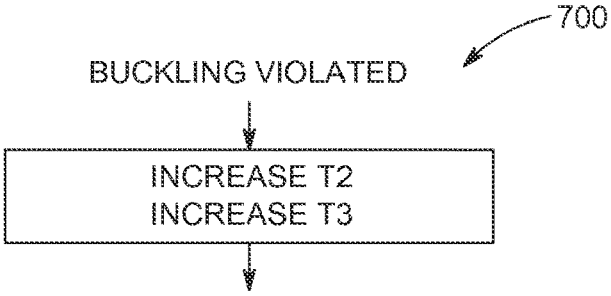
FIG. 7 is a flow chart of a second adjustment process based on adjusting the current stroke timing after the second set of constraints is violated as shown in FIG. 5.

FIG. 7 is a flow chart of a second adjustment process 700 based on adjusting 510 the current stroke timing after the second set of constraints is violated (shown in FIG. 5). Second adjustment process 700 is configured to adjust current stroke timing in response to a violation of the second set of constraints. In the exemplary embodiment, the second set of constraints is designed to prevent buckling of the sucker rod string. In the exemplary embodiment, in response to a violation of the second set of constraints, pumping control unit 212 adjusts current stroke timing by increasing T2 and T3 (both shown in FIG. 4).

Figure 8:
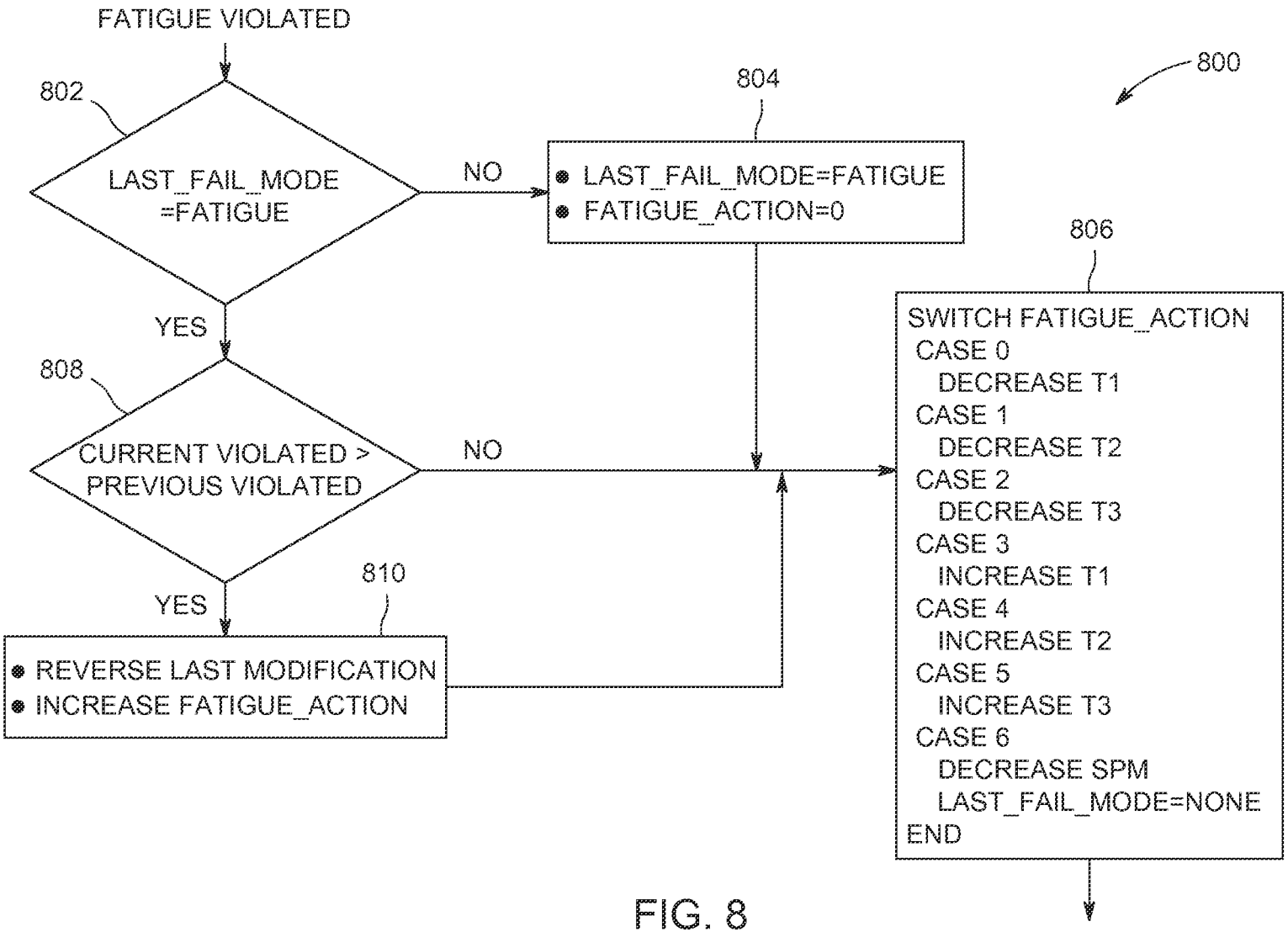
FIG. 8 is a flow chart of a third adjustment process based on adjusting the current stroke timing after the third set of constraints is violated as shown in FIG. 5.

FIG. 8 is a flow chart of a third adjustment process 800 based on adjusting 514 the current stroke timing after the third set of constraints is violated (shown in FIG. 5). Third adjustment process 800 is configured to adjust current stroke timing in response to a violation of the third set of constraints. In the exemplary embodiment, the third set of constraints is designed to prevent fatigue in the sucker rod string. Pumping control unit 212 determines 802 whether LAST_FAIL_MODE is FATIGUE. If the determination is no, then pumping control unit 212 sets 804 LAST_FAIL_MODE to FATIGUE and sets a FATIGUE_ACTION variable to zero.

Pumping control unit 212 determines 806 the value of FATIGUE_ACTION and adjusts current stroke timing based on that value. Below is a table of the values for FATIGUE_ACTION and the actions that pumping control unit 212 performs.

TABLE 1

| FATIQUE_ACTION Value | Action Performed |
|---|---|
| 0 | decrease T1 |
| 1 | decrease T2 |
| 2 | decrease T3 |
| 3 | increase T1 |
| 4 | increase T2 |
| 5 | increase T2 |
| 6 | increase T and set LAST_FAIL_MODE to NONE |

If pumping control unit 212 determines 802 that LAST_FAIL_MODE is FATIGUE, pumping control unit 212 determines 808 if the current violation of the third set of constraints is greater than the most recent previous violation of the third set of constraints. If the determination is that the current violation is not greater, pumping control unit 212 proceeds to Step 806. If the determination is that the current violation is greater, pumping control unit 212 reverses 810 the last modification made and increases FATIGUE_ACTION by 1. Then pumping control unit proceeds to Step 806.

The above-described system and methods provide a cost-effective method for controlling a rod pumping unit to enhance the flow of a fluid induced by the rod pumping unit based on current well conditions. Furthermore, the motion of the rod pumping unit is repeatedly updated to ensure that the motion of the sucker rod string will not damage the sucker rod string, the rod pumping unit, or the well itself. Also, the system and methods described herein are not limited to any single predefined set of well conditions. For example, the system and methods described herein may be used with varying well conditions and adapt over time as well conditions change. As such, the amount of flow of fluid induced by the rod pumping unit is constantly updated to be enhanced based on current well conditions and the capabilities of the rod pumping unit. As such, the production and efficiency of rod pumping units is increased.

An exemplary technical effect of the methods, systems, and apparatus described herein includes at least one of: (a) determining if any constraints have been violated during a stroke, where the constraints are ranked based on a predetermined hierarchy to identify potential stress on the sucker rod string or the rod pumping unit; (b) adjusting stroke timing based on the highest ranked constraint violated to reduce any stresses on the sucker rod string and the rod pumping unit; and (c) initiating a new stroke based on the adjusted stroke timing for enhanced fluid flow while reducing the stress on the sucker rod string and the rod pumping unit.

Exemplary embodiments of systems and methods for controlling the stroke of a rod pumping unit to control the flow of a fluid are described above in detail. The systems and methods described herein are not limited to the specific embodiments described herein, but rather, components of systems or steps of the methods may be utilized independently and separately from other components or steps described herein. For example, the methods may also be used in combination with other linear pumping units, and are not limited to practice with only linear pumping units as described herein. Rather, the exemplary embodiments may be implemented and utilized in connection with many other pumping control applications.

Although specific features of various embodiments may be shown in some drawings and not in others, this is for convenience only. In accordance with the principles of the systems and methods described herein, any feature of a drawing may be referenced or claimed in combination with any feature of any other drawing.

Some embodiments involve the use of one or more electronic or computing devices. Such devices typically include a processor or controller, such as a general purpose central processing unit (CPU), a graphics processing unit (GPU), a microcontroller, a reduced instruction set computer (RISC) processor, an application specific integrated circuit (ASIC), a programmable logic circuit (PLC), or any other circuit or processor capable of executing the functions described herein. The methods described herein may be encoded as executable instructions embodied in a computer readable medium, including, without limitation, a storage device or a memory device. Such instructions, when executed by a processor, cause the processor to perform at least a portion of the methods described herein. The above examples are exemplary only, and thus are not intended to limit in any way the definition or meaning of the term processor.

This written description uses examples to disclose the embodiments, including the best mode, and also to enable any person skilled in the art to practice the embodiments, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A system for enhancing a flow of a fluid induced by a rod pumping unit, said system comprising:

one or more sensors configured to monitor one or more conditions of the rod pumping unit and generate signals representing sensor data based on the one or more conditions; and a pumping control unit comprising a processor and a memory, said pumping control unit in communication with said one or more sensors, said pumping control unit configured to control stroke movement of the rod pumping unit, thereby controlling the flow of the fluid induced by the rod pumping unit, said pumping control unit configured to:

(a) initiate at least one stroke of the rod pumping unit, wherein the at least one stroke is based on current stroke timing data, wherein the current stroke timing data includes a value for strokes per minute (SPM);

(b) receive signals representing sensor data from the one or more sensors;

(c) upon a determination of, based on the sensor data, a violation of a first set of constraints, make a first adjustment to the current stroke timing, and return to step (a);

(d) upon a determination of, based on the sensor data, no violation of the first set of constraints and a violation of a second set of constraints, make a second adjustment to the current stroke timing, and return to step (a);

(e) upon a determination of, based on the sensor data, no violation of the first and second set of constraints and a violation of a third set of constraints, make a third adjustment to the current stroke timing, and return to step (a);

(f) upon a determination of, based on the sensor data, no violation of the first, second and third set of constraints, make a fourth adjustment to the current stroke timing, and return to step (a); and (g) upon a determination that the current stroke timing exceeds total time available for a stroke, perform at least one of reduce the value for SPM, and reverse one or more previously made adjustments.

2. The system in accordance with claim 1, wherein the fourth adjustment increases the value for SPM to increase the flow of fluid induced.

3. The system in accordance with claim 1, wherein the first set of constraints is based on one or more load and power specifications of the rod pumping unit.

4. The system in accordance with claim 1, wherein the second set of constraints is based on one or more buckling criterion.

5. The system in accordance with claim 1, wherein the third set of constraints is based on one or more fatigue criterion.

6. The system in accordance with claim 1, wherein the current stroke timing further includes at least one of an upstroke acceleration time, an upstroke deceleration time, a downstroke acceleration time, a downstroke deceleration time, an upstroke time, and an upper velocity parameter.

7. The system in accordance with claim 1, wherein the at least one stroke includes a plurality of stages which include an upstroke acceleration stage, an upstroke deceleration stage, a downstroke acceleration stage, a downstroke deceleration stage, and a constant velocity stage.

8. The system in accordance with claim 7, wherein said pumping control unit is further configured to:

determine a stage of the plurality of stages of the at least one stroke that the first constraint was violated;

determine last adjustment made to current stroke timing; and make the first adjustment based on the determined stage and the last adjustment made.

9. The system in accordance with claim 1, wherein said pumping control unit is further configured to store at least one of a last action made and a last fail mode based on which set of constraints was violated.

10. The system in accordance with claim 9, wherein upon a determination of, based on the sensor data, a violation of the third set of constraints, said pumping control unit is further configured to make the third adjustment based on an amount of violation of the third set of constraints, the last action made, and the last fail mode.

11. The system in accordance with claim 1, wherein said pumping control unit is further configured to:

simulate a recently made adjustment to the current stroke timing by stepping through steps (c), (d) and (e); and upon a determination of no violation of at least one set of constraints return to step (a).

12. A computer-based method for enhancing a flow of a fluid induced by a rod pumping unit, said method implemented using a pumping control unit in communication with a memory, said method comprising:

(a) initiating at least one stroke of the rod pumping unit, wherein the at least one stroke is based on current stroke timing data, wherein the current stroke timing data includes a value for strokes per minute (SPM);

(b) receiving signals representing sensor data from one or more sensors, wherein the one or more sensors are configured to monitor one or more conditions of the rod pumping unit and generate signals representing sensor data based on the one or more conditions;

(c) upon determining of, based on the sensor data, a violation of a first set of constraints, make a first adjustment to the current stroke timing, and return to step (a);

(d) upon determining of, based on the sensor data, no violation of the first set of constraints and a violation of a second set of constraints, make a second adjustment to the current stroke timing, and return to step (a);

(e) upon a determination of, based on the sensor data, no violation of the first and second set of constraints and a violation of a third set of constraints, make a third adjustment to the current stroke timing, and return to step (a);

(f) upon a determination of, based on the sensor data, no violation of the first, second and third set of constraints, make a fourth adjustment to the current stroke timing, and return to step (a); and (g) upon a determination that the current stroke timing exceeds total time available for a stroke, perform at least one of reduce the value for SPM, and reverse one or more previously made adjustments.

13. The method in accordance with claim 12, wherein the first set of constraints based on one or more load and power specifications of the rod pumping unit.

14. The method in accordance with claim 12, wherein the second set of constraints based on one or more buckling criterion.

15. The method in accordance with claim 12, wherein the third set of constraints based on one or more fatigue criterion.

16. The method in accordance with claim 12, wherein the current stroke timing further includes at least one of an upstroke acceleration time, an upstroke deceleration time, a downstroke acceleration time, a downstroke deceleration time, an upstroke time, and an upper velocity parameter.

17. The method in accordance with claim 12, wherein the at least one stroke includes a plurality of stages which include an upstroke acceleration stage, an upstroke deceleration stage, a downstroke acceleration stage, a downstroke deceleration stage, and a constant velocity stage.

18. A non-transitory computer-readable storage medium having processor-executable instructions embodied thereon, for enhancing a flow of a fluid induced by a rod pumping unit, wherein when executed by a pumping control unit communicatively coupled to a memory, the processor-executable instructions cause the pumping control unit to:

(a) initiate at least one stroke of the rod pumping unit, wherein the at least one stroke is based on current stroke timing data, wherein the current stroke timing data includes a value for strokes per minute (SPM);

(b) receive signals representing sensor data from one or more sensors, wherein the one or more sensors are configured to monitor one or more conditions of the rod pumping unit and generate signals representing sensor data based on the one or more conditions;

(c) upon a determination of, based on the sensor data, a violation of a first set of constraints, make a first adjustment to the current stroke timing, and return to step (a);

(d) upon a determination of, based on the sensor data, no violation of the first set of constraints and a violation of a second set of constraints, make a second adjustment to the current stroke timing, and return to step (a);

(e) upon a determination of, based on the sensor data, no violation of the first and second set of constraints and a violation of a third set of constraints, make a third adjustment to the current stroke timing, and return to step (a);

(f) upon a determination of, based on the sensor data, no violation of the first, second and third set of constraints, make a fourth adjustment to the current stroke timing, and return to step (a); and (g) upon a determination that the current stroke timing exceeds total time available for a stroke, perform at least one of reduce the value for SPM, and reverse one or more previously made adjustments.

19. The computer readable storage device of claim 18, wherein the first set of constraints based on one or more load and power specifications of the rod pumping unit.

20. The computer readable storage device of claim 18, wherein the second set of constraints based on one or more buckling criterion.

21. The computer readable storage device of claim 18, wherein the third set of constraints based on one or more fatigue criterion.

22. The computer readable storage device of claim 18, wherein the current stroke timing further includes at least one of an upstroke acceleration time, an upstroke deceleration time, a downstroke acceleration time, a downstroke deceleration time, an upstroke time, and an upper velocity parameter.

23. The computer readable storage device of claim 18, wherein the at least one stroke includes a plurality of stages which include an upstroke acceleration stage, an upstroke deceleration stage, a downstroke acceleration stage, a downstroke deceleration stage, and a constant velocity stage.

* * * * *